US010006201B2

(12) United States Patent
Davis

(10) Patent No.: US 10,006,201 B2
(45) Date of Patent: Jun. 26, 2018

(54) STRUCTURAL SUPPORT BEAM

(71) Applicant: C. Douglas Davis, Brooksville, FL (US)

(72) Inventor: C. Douglas Davis, Brooksville, FL (US)

( * ) Notice: Subject to any disclaimer, the term of this patent is extended or adjusted under 35 U.S.C. 154(b) by 0 days. days.

(21) Appl. No.: 15/731,297

(22) Filed: May 19, 2017

(65) Prior Publication Data

US 2017/0298629 A1 Oct. 19, 2017

Related U.S. Application Data

(62) Division of application No. 14/545,792, filed on Jun. 19, 2015, now Pat. No. 9,657,477.

(51) Int. Cl.

| | |
|---|---|
| ***E04C 3/11*** | (2006.01) |
| ***E04C 3/06*** | (2006.01) |
| ***E04C 3/17*** | (2006.01) |
| ***E04C 3/20*** | (2006.01) |
| ***E04C 3/28*** | (2006.01) |
| *E04C 3/04* | (2006.01) |

(52) U.S. Cl.

CPC ..... *E04C 3/11* (2013.01); *E04C 3/06* (2013.01); *E04C 3/17* (2013.01); *E04C 3/20* (2013.01); *E04C 3/28* (2013.01); *E04C 2003/0408* (2013.01); *E04C 2003/0413* (2013.01); *E04C 2003/0452* (2013.01)

(58) Field of Classification Search

None

See application file for complete search history.

(56) References Cited

U.S. PATENT DOCUMENTS

| | | | | | |
|---|---|---|---|---|---|
| 1,843,318 | A * | 2/1932 | Frease | E04C 3/06 | 52/690 |
| 3,066,394 | A * | 12/1962 | Litzka | B21D 47/04 | 29/281.4 |
| 3,197,610 | A * | 7/1965 | Litzka | B21D 47/04 | 219/124.21 |
| 3,283,464 | A * | 11/1966 | Litzka | B21D 47/04 | 29/897.31 |
| 3,300,839 | A * | 1/1967 | Lichti | B21D 47/04 | 228/173.6 |
| 3,516,213 | A * | 6/1970 | Sauer | E04B 1/944 | 52/474 |
| 3,908,327 | A * | 9/1975 | Quigg | E04B 1/944 | 52/359 |
| 4,019,301 | A * | 4/1977 | Fox | E02D 5/60 | 405/216 |
| 4,047,341 | A * | 9/1977 | Bernardi | E04B 1/2403 | 403/230 |
| 4,986,051 | A * | 1/1991 | Meyer | E04C 3/07 | 14/74.5 |

(Continued)

*Primary Examiner* — Brian E Glessner
*Assistant Examiner* — Adam G Barlow

(57) ABSTRACT

A structural support beam for use in buildings, bridges, mechanical frames and the like to resist bending due to gravitational and external forces comprising a top substantially flat flange disposed in fixed spaced relationship relative to a bottom substantially concave flange by an interconnecting web and a lower stabilizing brace disposed to engage the opposite end portions of the bottom substantially concave flange and the opposite end portions of the interconnecting web to reinforce the interconnection therebetween.

8 Claims, 11 Drawing Sheets

(56) References Cited

U.S. PATENT DOCUMENTS

| | | | | | |
|---|---|---|---|---|---|
| 5,125,207 | A * | 6/1992 | Strobl, Jr. | E04L 1/0046 | 52/204.62 |
| 5,509,250 | A * | 4/1996 | Jensen | E04C 2/543 | 52/200 |
| 5,771,653 | A * | 6/1998 | Dolati | E04C 3/07 | 52/545 |
| 6,058,673 | A * | 5/2000 | Wycech | B29C 44/18 | 296/187.02 |
| 6,460,309 | B1 * | 10/2002 | Schneider | E04B 1/0046 | 52/837 |
| 7,213,379 | B2 * | 5/2007 | Carlson | E04C 3/29 | 52/837 |
| 8,028,493 | B2 * | 10/2011 | Holmes | E04B 5/29 | 52/745.05 |
| 2004/0040233 | A1 * | 3/2004 | Park | E04C 3/10 | 52/223.8 |
| 2005/0108978 | A1 * | 5/2005 | Strickland | B21D 47/01 | 52/633 |
| 2006/0150571 | A1 * | 7/2006 | Zahner, III | E04C 3/02 | 52/838 |

* cited by examiner

STRUCTURAL SUPPORT BEAM

CROSS-REFERENCE

This is a divisional application claiming priority of co-pending application Ser. No. 14/545,792 filed Jun. 19, 2015.

BACKGROUND OF THE INVENTION

Field of the Invention

A structural support beam for use in buildings, bridges, automotive frames and the like.

Description of the Prior Art

A beam is a structural element that is capable of withstanding load primarily by resisting bending. The bending force induced into the material of the beam as a result of the external loads, own weight, span and external reactions to these loads is called a bending moment.

Beams are traditionally descriptions of building or civil engineering structural elements, but smaller structures such as truck or automobile frames, machine frames, and other mechanical or structural systems contain beam structures that are designed and analyzed in a similar fashion.

In engineering, beams are of several types:

Simply supported—a beam supported on the ends which are free to rotate and have no moment resistance.

Fixed—a beam supported on both ends and restrained from rotation.

Over hanging—a simple beam extending beyond its support on one end.

Double overhanging—a simple beam extending beyond its supports ends.

Continuous—a beam extending over more than two supports.

Cantilever—a projecting beam fixed only at one end.

Trussed—a beam strengthened by adding a cable or rod to form a truss.

Most beams in reinforced concrete buildings have rectangular cross sections, but a more efficient cross section for a beam is an I or H section which is typically seen in steel construction. Because of the parallel axis theorem and the fact that most of the material is away from the neutral axis, the second moment of area of the beam increases, which in turn increases the stiffness.

An I-beam is only the most efficient shape in one direction of bending: up and down looking at the profile as an I. If the beam is bent side to side, it functions as an H where it is less efficient. The most efficient shape for both directions is a box (a square shell) or tube. But, however the most efficient shape for bending in any direction is a cylindrical shell or tube. But, for unidirectional bending, the I or wide flange beam is superior.

Cross-sectional views of more typical configurations or shapes are depicted in FIG. 1A through FIG. 1F.

Internally, beams experience compressive, tensile and shear stresses as a result of the loads applied to them. Typically, under gravity loads, the original length of the beam is slightly reduced to enclose a smaller radius arc at the top of the beam, resulting in compression, while the same original beam length at the bottom of the beam is slightly stretched to enclose a larger radius arc, and so is under tension. The same original length of the middle of the beam, generally halfway between the top and bottom, is the same as the radial arc of bending, and so it is under neither compression nor tension, and defines the neutral axis dotted line in the beam figure. Above the supports, the beam is exposed to shear stress. There are some reinforced concrete beams in which the concrete is entirely in compression with tensile forces taken by steel tendons. These beams are known as prestressed concrete beams, and are fabricated to produce a compression more than the expected tension under loading conditions. High strength steel tendons are stretched while the beam is cast over them. Then, when the concrete has cured, the tendons are slowly released and the beam is immediately under eccentric axial loads. This eccentric loading creates an internal moment, and, in turn, increases the moment carrying capacity of the beam. They are commonly used on highway bridges.

The following references illustrate the prior art.

U.S. Pat. No. 1,843,318 discloses an arch comprising a curved lower chord having reinforcing bars 24 and 24' secured at each side of the lower curved edge of the arch to absorb the thrust (see FIG. 16).

U.S. Pat. No. 4,831,800 relates to a beam and reinforcing member comprising a longitudinally extending beam having a concrete upper flange, a web having greater tensile strength than concrete and rigidly connected to the upper flange with shear connectors. The web extends transversely downward from the upper flange longitudinally spaced apart leg portions with an intermediate arched portion extending between the leg portions.

U.S. Pat. No. 4,704,830 shows a flexible tension load bearing member such as a chain strung alongside an I-beam web portion end to end and hooked over the top flange. The mid-section of the chain is then attached in a load bearing capacity to the lower flange, preferably by a post tension controlling adjustable link controlling the chain tension.

Additional examples are found in U.S. Pat. No. 3,010,257; U.S. Pat. No. 3,101,272; U.S. Pat. No. 3,283,464; U.S. Pat. No. 3,300,839; U.S. Pat. No. 3,535,768; U.S. Pat. No. 4,424,652; U.S. Pat. No. 4,576,849 and U.S. Pat. No. 5,125,207.

SUMMARY OF THE INVENTION

Numerous different shapes and configurations of support beam structures have been designed for specific applications and strengths.

The present invention relates to a structural support beam configured for enhanced structural strength.

The structural support beam comprises a top flange held in fixed spaced relationship relative to a bottom concave flange by an interconnecting web including a lower concave surface having a radius of curvature substantially equal to the radius of curvature of the bottom concave flange such that when assembled the top flange, bottom concave flange and interconnecting web form an integral structural beam.

It has been observed that excessive tension forces exerted on opposite ends of the structure support beam may cause the bottom concave flange to separate from the interconnecting web. A lower stabilizer or retainer is secured to the structural support beam to prevent the bottom concave flange and the interconnecting web from separating. When the structural support beam and lower stabilizer or retainer are affixed together in the inner surface of each retainer member engages the corresponding end surface of the bottom concave flange, the corresponding end surface of the interconnecting web and the corresponding end surface of the top flange to secure the top flange, bottom concave flange, and interconnecting web together.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Numerous shapes and configurations of support beam structures are exemplified in FIGS. 1A through 1F. Generally, these configurations are selected for specific application and strength. To provide additional strength different materials are employed. In addition, the gauge or thickness of the material used is varied to meet specific stress and strength requirement.

Figure 1A:
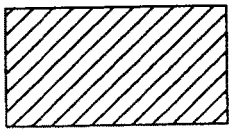
FIG. 1A is a cross-sectional end view of a T-shaped support beam of the present invention.
Figure 1B:
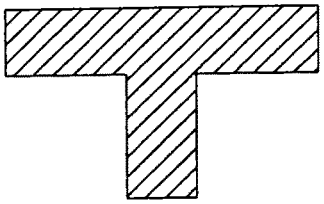
FIG. 1B is a cross-sectional end view of a T-shaped support beam of the present invention.
Figure 1C:
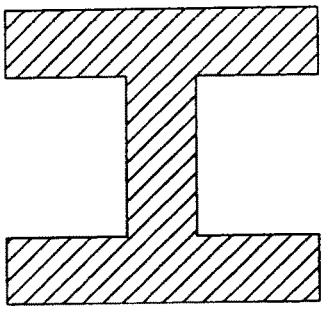
FIG. 1C is a cross-sectional end view of an I-shaped support beam of the present invention.
Figure 1D:
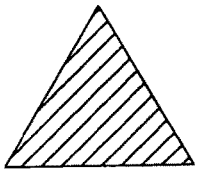
FIG. 1D is a cross-sectional end view of a triangular shaped support bias of the present invention.
Figure 1E:
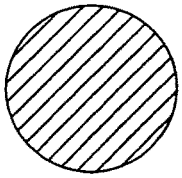
FIG. 1E is a cross-sectional end view of a triangular shaped support beam of the present invention.
Figure 1F:
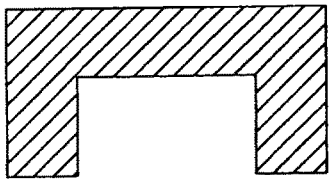
FIG. 1F is a cross-sectional end view of a C or U shaped beam of the present invention.
Figure 2:
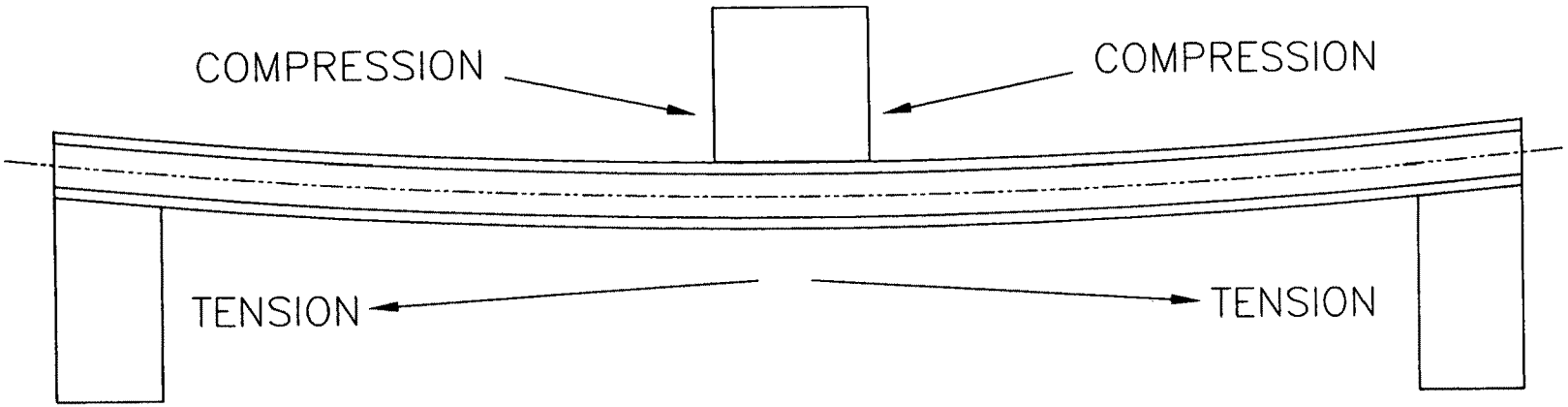
FIG. 2 is a side view of an I-beam under stress supported on pilings or pillars.

FIG. 2 illustrates the compression and tension forces exerted on a load bearing support I-beam.

These designs have inherent limitations due to the geometry of the beams in dealing with forces depicted in FIG. 2.

The purpose of the present invention is to create a new geometry design that will provide greater strength while reducing weight in a single member unit to be used in load carrying applications similar to a beam.

Its function is to redirect the downward forces of gravity in such a manner as to cause the forces into compression on the load carrying top section thus causing the forces to be lateral or horizontal and then to transfer the forces to the ends where the connection will be made. The bottom section will not be connected except on the ends where connections will be made, and the downward forces will transfer. It should be noted the upper section and lower section are not connected except on the ends and thus remove the shear effect from the upper section and remove the deflection effects from the lower section and allow effects to be altered needed.

Figure 3:
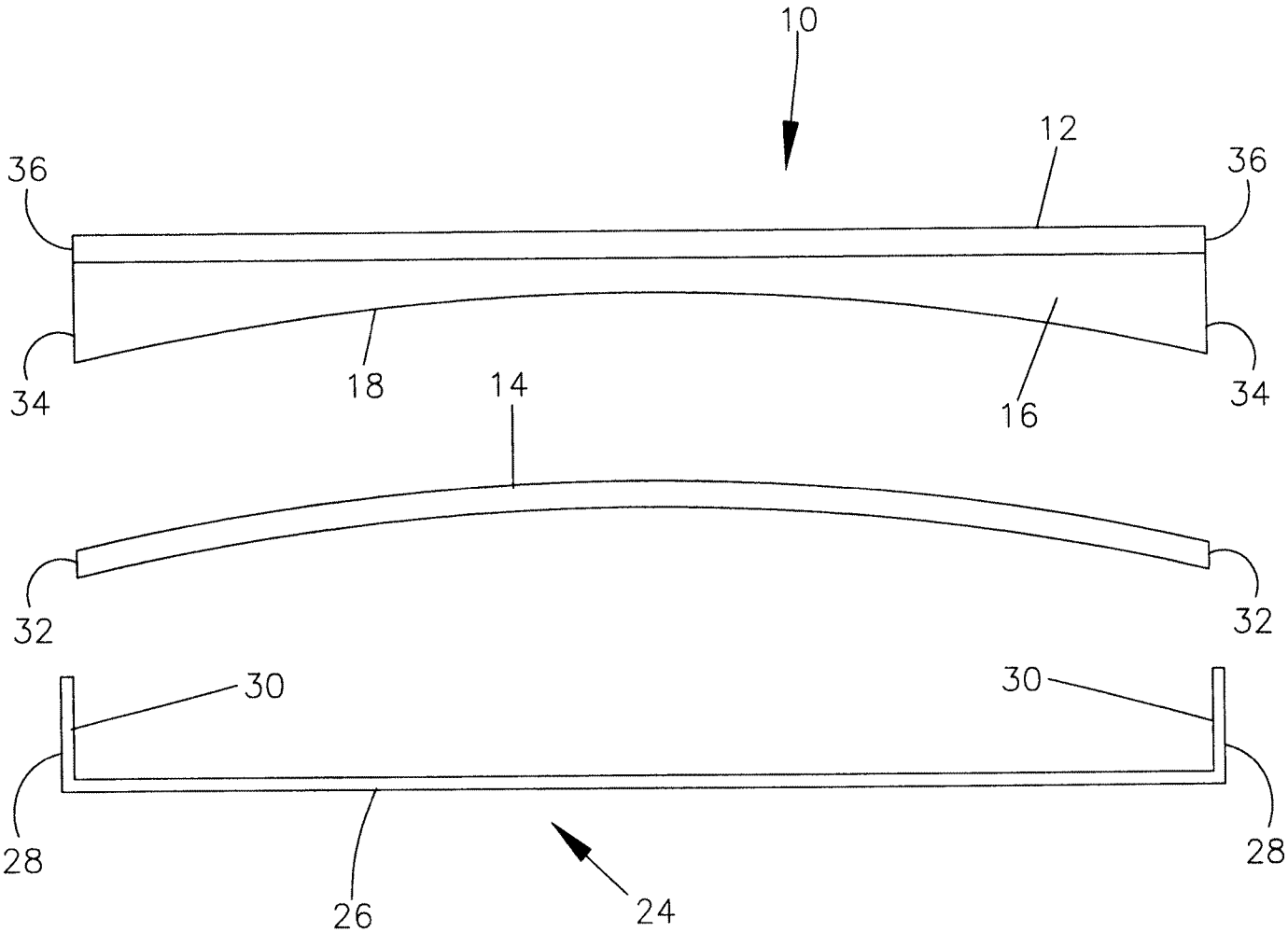
FIG. 3 is an exploded side view of the structural support beam of the present invention.
Figure 4:
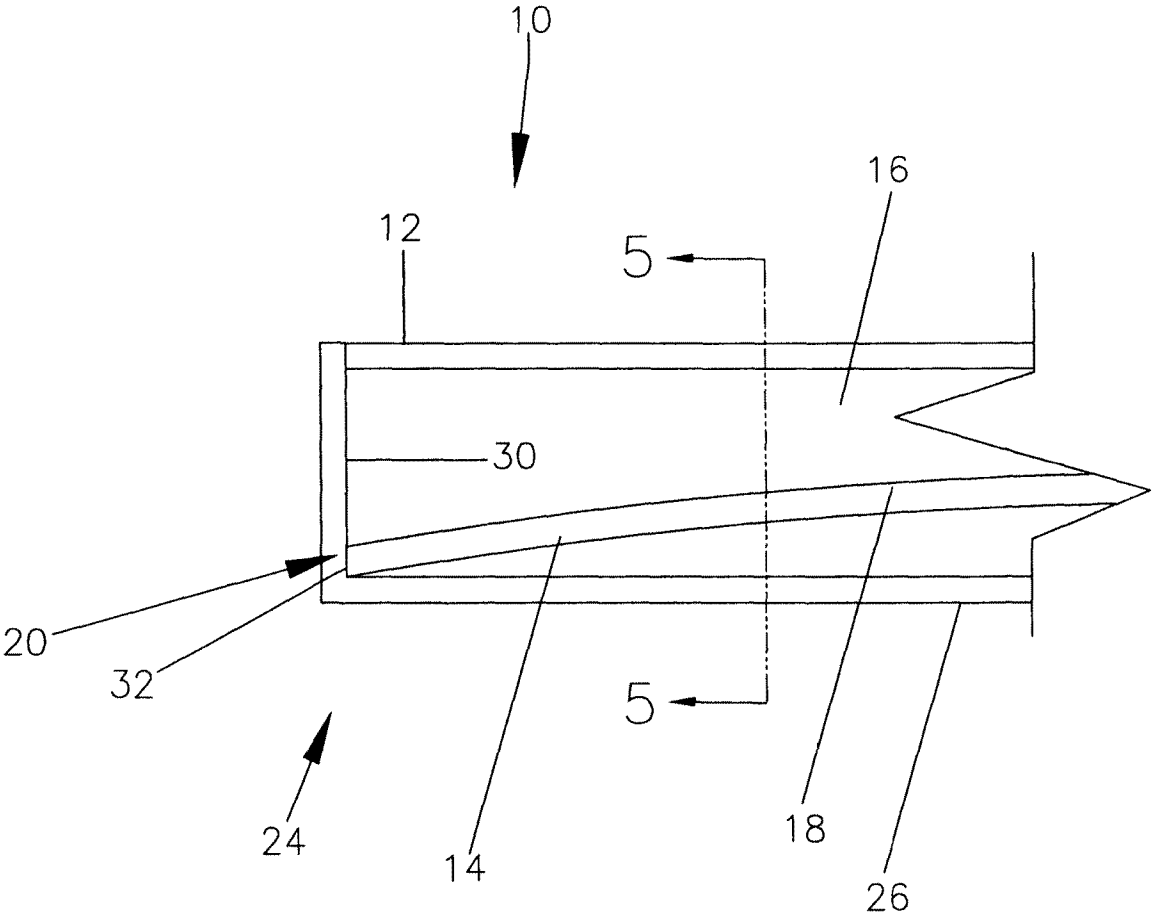
FIG. 4 is a partial side view of the structural support beam of the present invention.
Figure 5:
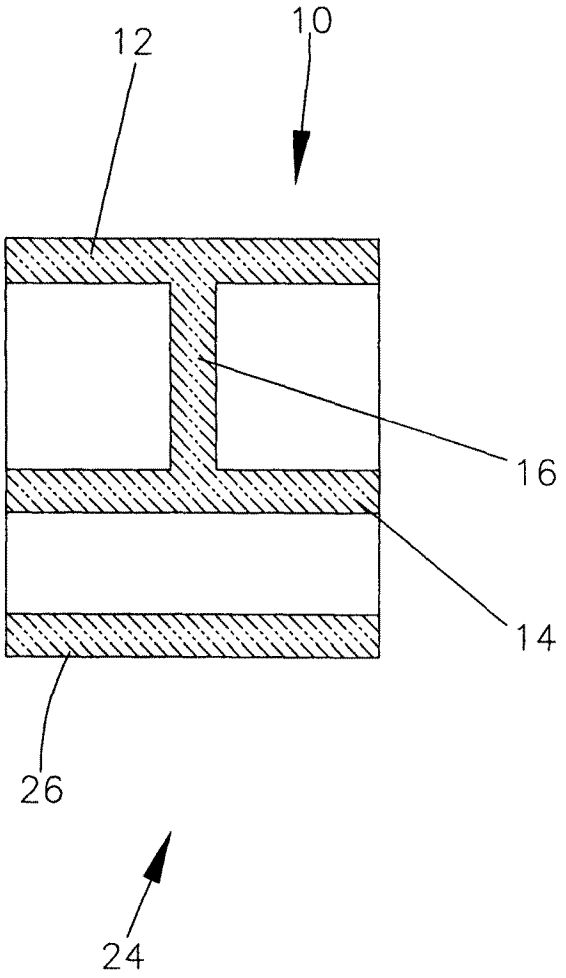
FIG. 5 is a cross-sectional end view of the structural support beam of the present invention taken along line 5-5 of FIG. 4.

FIGS. 3 through 5 depict the structural support beam of the present invention generally indicated as 10. The structural support beams described below may be constructed from a variety of materials such as metals including steel, aluminum or magnesium, fiberglass, concrete, wood, carbon fiber or generally used construction materials.

The structural support beam 10 comprises a top substantially flat flange 12 held in fixed spaced relationship relative to a bottom substantially concave flange 14 by a substantially flat interconnecting web 16 including a lower concave surface 18 having a radius of curvature substantially equal to the radius of curvature of the bottom substantially concave flange 14 such that when assembled the top substantially flat flange 12, bottom substantially concave flange 14 and substantially flat interconnecting web 16 form an integral structural beam as best shown in FIG. 4.

As depicted in FIG. 5, the substantially flat interconnecting web 16 is substantially perpendicular to the top substantially flat flange 12 and the bottom substantially concave flange 14.

It has been observed that excessive tension forces exerted on opposite ends each generally indicated as 20 of the structural support beam 10 may cause the bottom substantially concave flange 14 to separate from the substantially flat interconnecting web 16. A lower stabilizer or retainer generally indicated as 24 is secured to the structural support beam 10 to prevent the bottom substantially concave flange 14 and the substantially flat interconnecting web 16 from separating or substantially deflecting. Specifically, the lower stabilizer or retainer 24 comprises a substantially flat longitudinally disposed brace 26 having a substantially flat retainer member 28 formed at each end thereof. The substantially flat longitudinally disposed brace 26 is substantially parallel to the top substantially flat flange 12; while, the retainer members 28 are substantially perpendicular to the top substantially flat flange 12, bottom substantially concave flange 14 and substantially flat interconnecting web 16.

Thus, when the structural support beam 10 and lower stabilizer or retainer 24 are affixed together as shown in FIG. 4, the inner surface 30 of each retainer member 28 engages the corresponding end surface 32 of the bottom substantially concave flange 14, the corresponding end surface 34 of the substantially flat interconnecting web 16 and the corresponding end surface 36 of the top substantially flat flange 12 to secure the top substantially flat flange 12, bottom substantially concave flange 14, and substantially flat interconnecting web 16 together.

Figure 6:
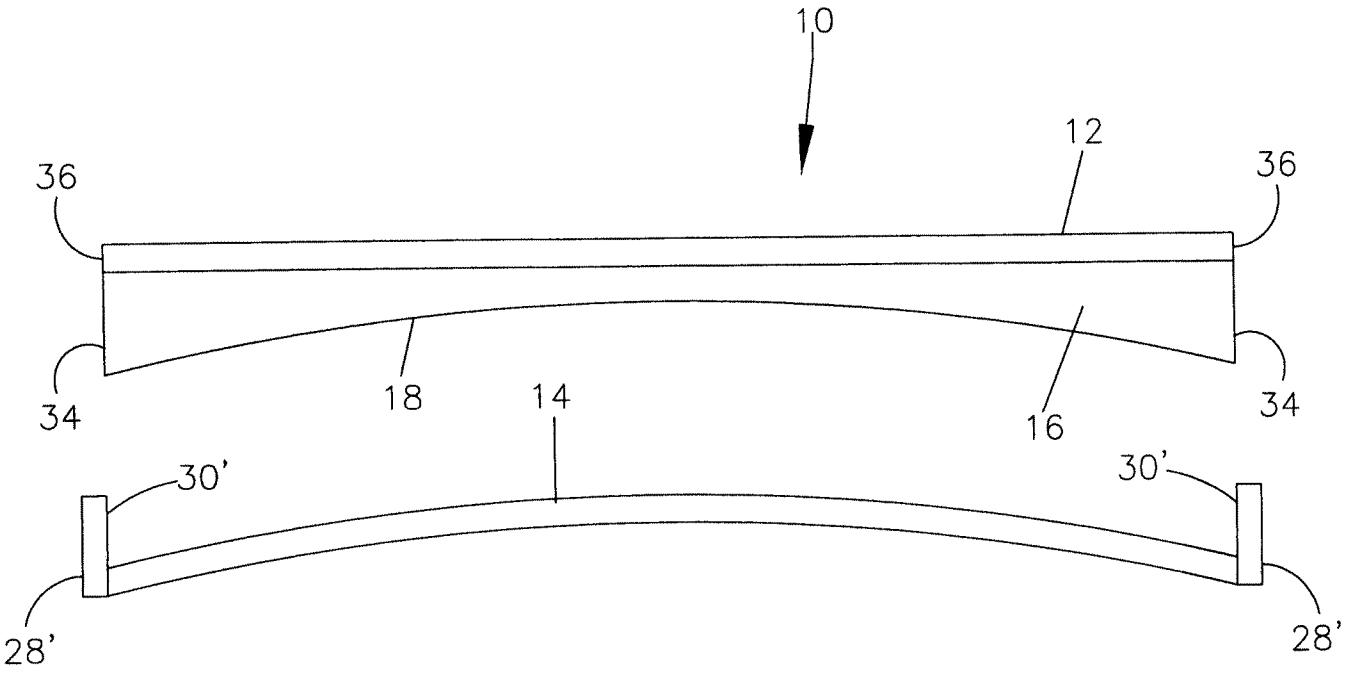
FIG. 6 is an exploded side view of an alternate embodiment of the structural support beam of the present invention.

FIG. 6 depicts an alternative embodiment of the structural support beam.

Specifically, the structural support beam 10 comprised a top substantially flat flange 12 held in fixed spaced relationship relative to a bottom substantially concave flange 14 by a substantially flat interconnecting web 16 including a lower concave surface 18 having a radius of curvature substantially equal to the radius of curvature of the substantially concave flange 14 such that when assembled, the top substantially flat flange 12, bottom substantially concave flange 14 and substantially flat interconnecting web 16 for an integral structural beam 10 similar to that best shown in FIGS. 4 and 5.

In addition, a substantially flat retainer member 28' is formed on each end of the substantially concave bottom flange 14. The substantially flat retainer members 28' are substantially perpendicular to the top substantially flat flange beam 12, bottom substantially concave flange 14 and substantially flat interconnecting web 16 such that when the structural support beam 10 is fully assembled the inner surface 30' of each substantially flat retainer member 28' engage the corresponding end surface 34 of the substantially flat interconnecting web 16 and corresponding end surface 36 of the top substantially flat flange 12 to secure the top substantially flat flange 12, bottom substantially concave flange 14 and substantially flat interconnecting web 16 together as an integrated unit by welding or similar method.

Figure 7:
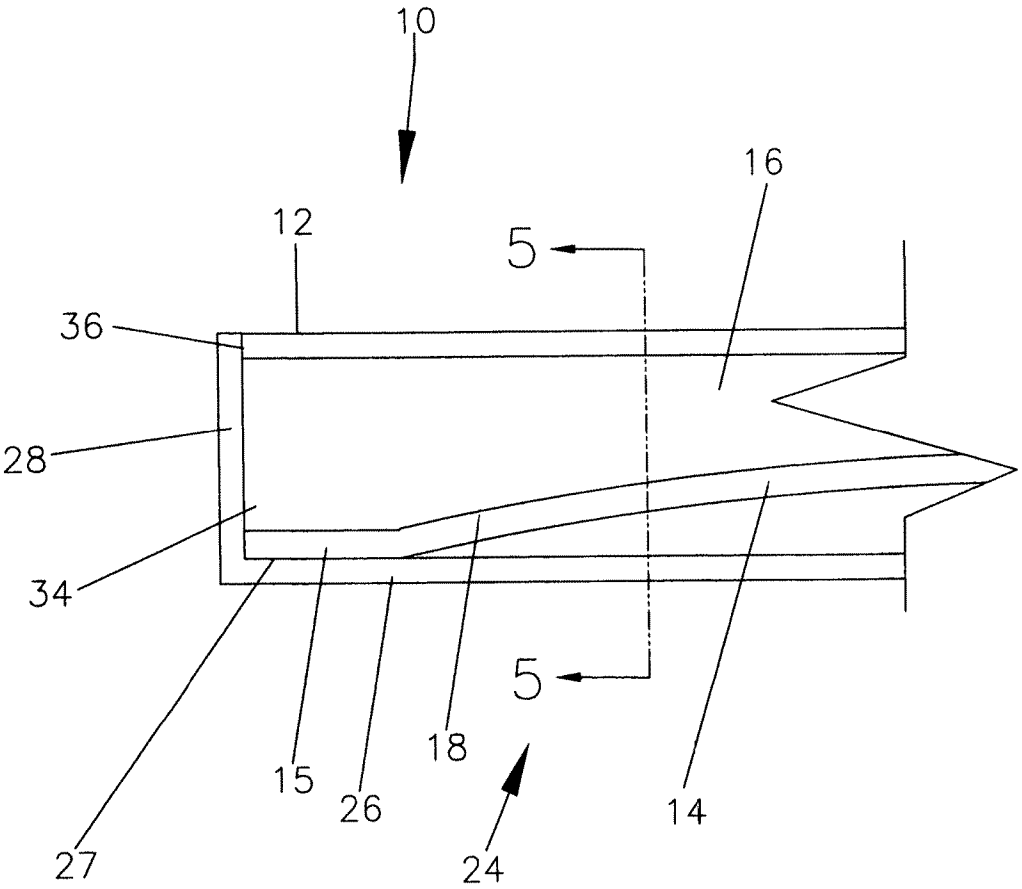
FIG. 7 is a side view of another alternate embodiment of the structural support beam of the present invention.

FIG. 7 shows another alternate embodiment of the structural support beam 10. Specifically, the structural support beam 10 comprises a top substantially flat flange 12 held in fixed spaced relationship relative to a bottom substantially concave flange 14 by a substantially flat interconnecting web 16 including a lower concave surface 18 having a radius of curvature substantially equal to the radius of curvature of the substantially concave flange equal to the radius of curvature of the substantially concave flange 14 such that when assembled, the top substantially flat flange 12, bottom substantially concave flange 14 and substantially flat interconnecting web 16 form an integral structural beam 10 similar to that shown in FIG. 4. Each end portion of the bottom substantially concave flange 14 comprises a flat end portion 15.

As depicted in FIG. 7, the substantially flat interconnecting web is substantially perpendicular to the top substantially flat flange 12 and the bottom substantially concave flange 14.

A lower stabilizer or retainer generally indicated as 24 is secured to the structural support beam 10 to prevent the bottom substantially concave beam 18 and the substantially flat interconnecting web 16 from separating or substantially deflecting. Specifically, the lower stabilizer or retainer 24 comprises a substantially flat longitudinally disposed brace 26 having a substantially flat retainer member 28 formed at each end thereof. The substantially flat longitudinally disposed brace 26 is substantially parallel to the top substantially flat flange 12; while, the retainer members 28 are substantially perpendicular to the top substantially flat flange 12, bottom substantially concave flange 14 and substantially flat interconnecting web 16.

Thus, when the structural support flange 10 and lower stabilizer or retainer 24 are affixed together as shown in FIG. 7, the inner surface 30 of each retainer member 28 engages the corresponding end surface 30 of the bottom substantially concave flange 14, the corresponding end surface 34 of the substantially flat interconnecting web 16 and the corresponding end surface 36 of the top substantially flat flange 12 to secure the top substantially flat flange 12, bottom substantially concave flange 14, and substantially flat interconnecting web 16 together. In addition, each flat end portion 15 is welded or otherwise affixed to the upper surface at each end of the substantially flat longitudinally disposed brace 26.

Figure 8:
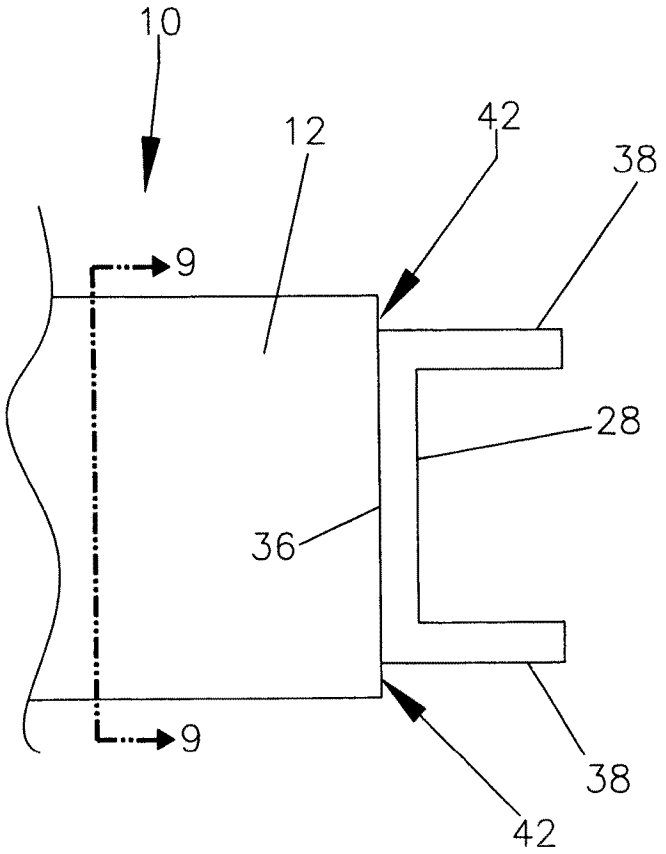
FIG. 8 is a top view of yet another embodiment of the structural support beam of the present invention.
Figure 9:
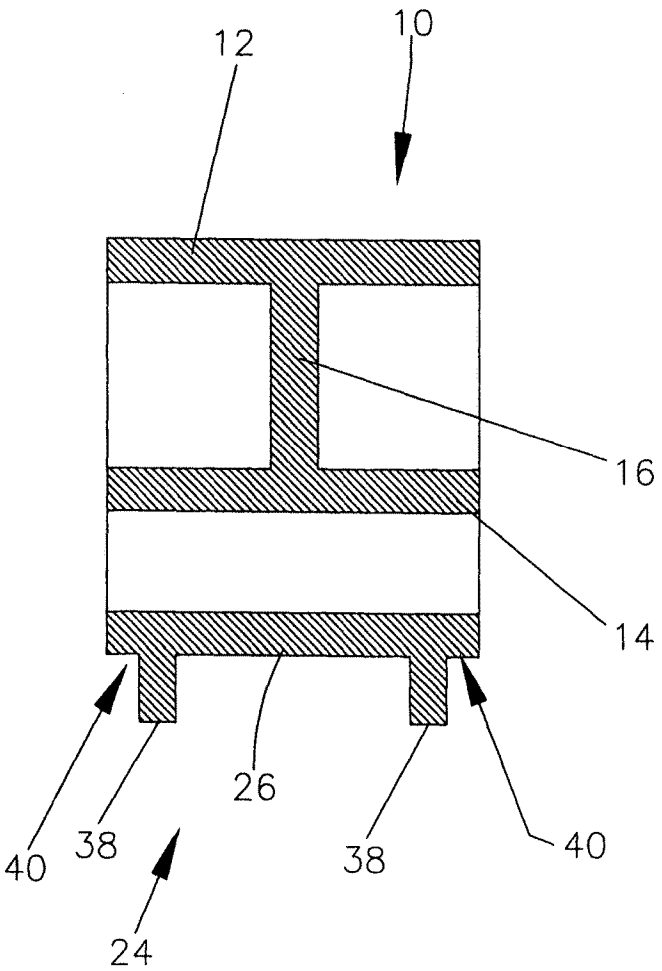
FIG. 9 is a cross-sectional end view of the structural support beam of the present invention taken along line 9-9 of FIG. 8.

FIGS. 8 and 9 depict yet another alternative embodiment of the structural support beam 10 similar to the structural support beam 10 shown in FIGS. 3 through 5.

Specifically, the structural support beam 10 comprised a top substantially flat flange 12 held in fixed spaced relationship relative to a bottom substantially concave flange 14 by a substantially flat interconnecting web 16 including a lower concave surface 18 having a radius of curvature substantially equal to the radius of curvature of the substantially concave flange 14 such that when assembled, the top substantially flat flange 12, bottom substantially concave flange 14 and substantially flat interconnecting web 16 for an integral structural beam 10 similar to that best shown in FIGS. 4 and 5.

In addition, a substantially flat reinforcing rib 38 is formed on and substantially perpendicular to each side portion 40 of the substantially flat longitudinally disposed brace 26 and each side portion 42 of each substantially flat retainer member 28.

Figure 10:
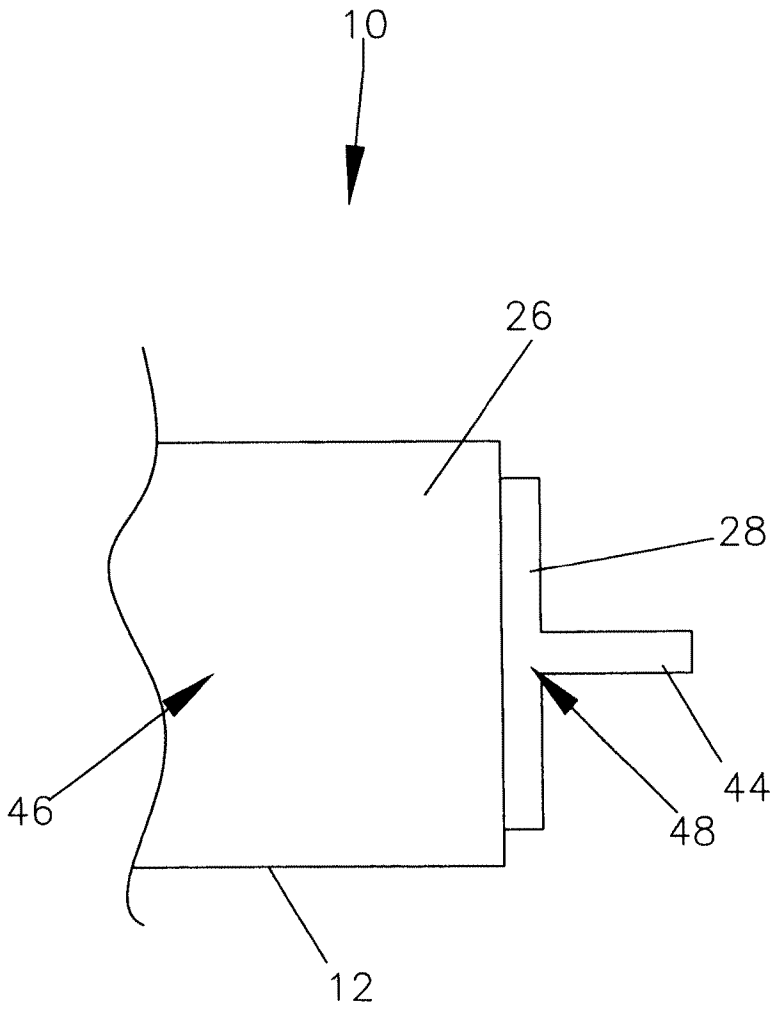
FIG. 10 is a top view of still another alternate embodiment of the structural support beam of the present invention.

FIG. 10 depicts still another alternative embodiment of the structural support beam.

Specifically, the structural support beam 10 comprised a top substantially flat flange 12 held in fixed spaced relationship relative to a bottom substantially concave flange 14 by a substantially flat interconnecting web 16 including a lower concave surface 18 having a radius of curvature substantially equal to the radius of curvature of the substantially concave flange 14 such that when assembled, the top substantially flat flange 12, bottom substantially concave flange 14 and substantially flat interconnecting web 16 for an integral structural beam 10 similar to that best shown in FIGS. 4 and 5.

In addition, a substantially flat reinforcing rib 44 is formed on and substantially perpendicular to the longitudinally mid portion 46 of the substantially flat longitudinally disposed brace 26 and the mid portion 48 of each substantially flat retainer member 28.

Figure 11:
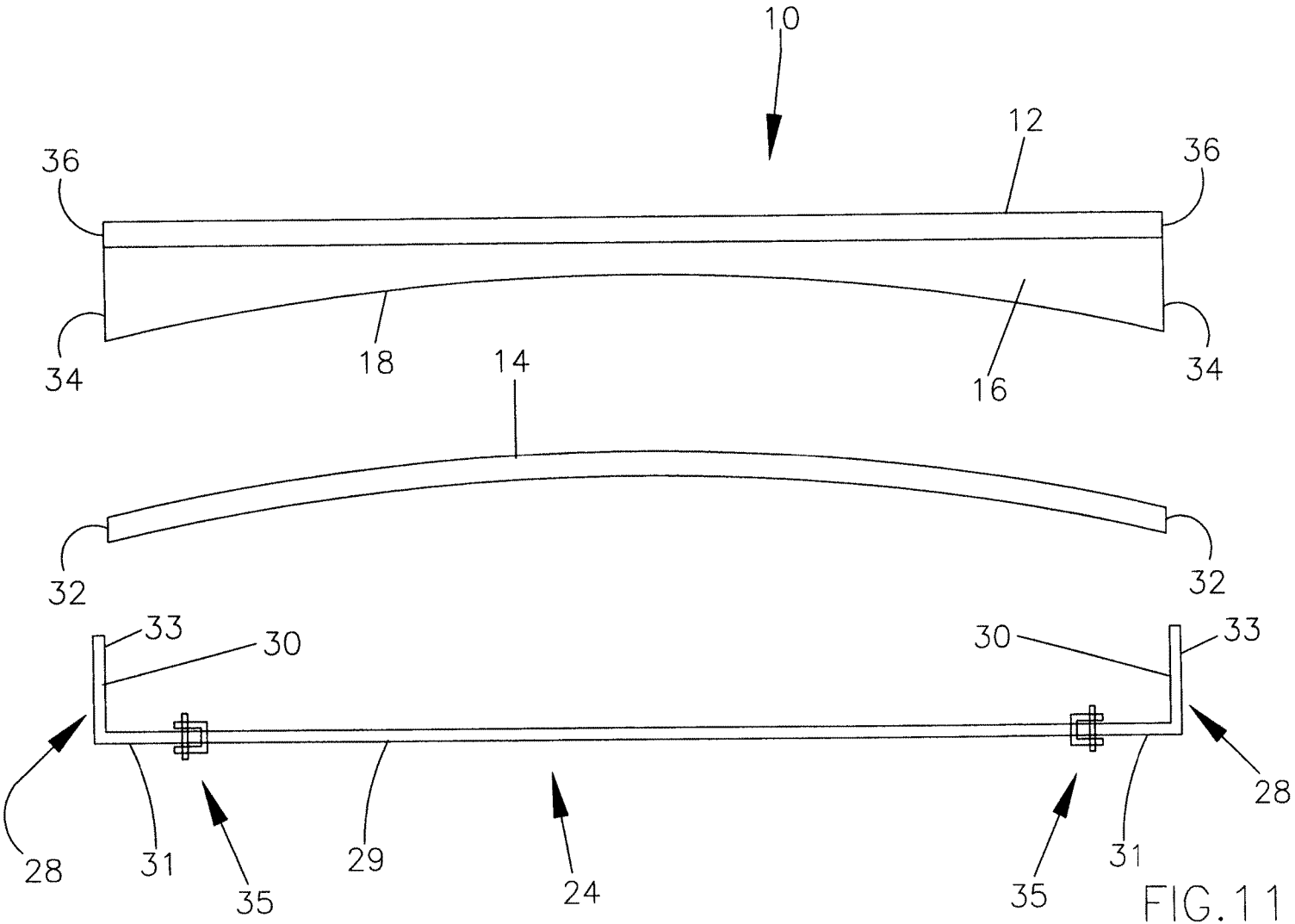
FIG. 11 is a side view of the structural support beam of the present invention with an alternate embodiment of the lower stabilizer or retainer.

FIG. 11 shows an alternate embodiment of the lower stabilizer or retainer 24. Specifically, the lower stabilizer or retainer 24 comprises a pair of retainer members each generally indicated as 28 operatively coupled together by an intermediate longitudinally disposed brace 29 by a corresponding pair of coupling devices each generally indicated as 35.

Each retainer member 28 comprises a first retainer leg 31 substantially parallel to the top substantially flat flange and a second retainer leg 33 disposed substantially perpendicular to the top substantially flat flange 12, bottom substantially concave flange 14 and substantially flat interconnecting web 16.

The intermediate longitudinally disposed brace 29 comprises a flexible member such as a cable or chain drawn tight or taut by the coupling devices each generally indicated as 35 such as a turn-buckle or the like.

When the structural support beam 10 and lower stabilizer or retainer 24 are affixed together, the inner surface 30 of each second retainer leg 33 engages the corresponding end surface 32 of the bottom substantially concave flange 14, the corresponding end surface 34 of the substantially flat interconnecting web 16 and the corresponding end surface 36 of the top substantially flat flange 12 to secure the top substantially flat flange 12, bottom substantially concave flange 14, and substantially flat interconnecting web 16 together.

Of course, each of the structural elements are welded or otherwise affixed together.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A structural support beam configured to resist bending due to gravitational forces and external loads comprising a top substantially flat flange held in fixed spaced relationship relative to a bottom substantially concave flange by an interconnecting web including a concave lower surface having substantially the same radius of curvature as said bottom substantially concave flange and a lower stabilizer comprising a substantially flat brace including an upper surface disposed in substantially parallel relation relative to said top substantially flat flange and a separate retainer member secured to each end portion of said substantially flat brace, each said separate retainer member including an inner surface and an outer surface disposed substantially perpendicular to said top substantially flat flange and said bottom substantially concave flange disposed to engage a corresponding end surface of said bottom substantially concave flange, a corresponding end surface of said substantially flat interconnecting web and a corresponding end surface of said top substantially flat flange to secure said top substantially flat flange, said bottom substantially concave flange and said interconnecting web together and limit longitudinal expansion thereof.

2. The structural support beam of claim 1 further including a reinforcing rib extending outwardly from each said retainer member.

3. The structural support beam of claim 1 further including a reinforcing rib extending downwardly from opposite side portions of said lower stabilizer.

4. A structural support beam configured to resist bending due to gravitational forces and external loads comprising a top substantially flat flange having a substantially flat end surface formed on each end thereof held in fixed spaced relationship relative to a bottom flange including a substantially concave upper surface and having a substantially flat end surface formed on each end thereof by an interconnecting web including a lower concave lower surface with substantially the same radius of curvature as said bottom flange and having a substantially flat end surface formed on each end thereof, and a lower stabilizer comprising a substantially flat brace including an upper surface disposed in substantially parallel relation relative to said top substantially flat flange and having a retainer member disposed on each end of said substantially flat brace, each said retainer member including an inner surface disposed substantially perpendicular to said substantially flat brace, said top substantially flat flange, said interconnecting web and said bottom flange wherein said inner surface of each said retainer member is disposed to engage a corresponding end surface of said bottom flange, a corresponding end surface of said substantially flat interconnecting web and a corresponding end surface of said top substantially flat flange to secure said top substantially flat flange, said bottom flange and said interconnecting web together and limit longitudinal expansion thereof.

5. The structural support beam of claim 4 further including a reinforcing rib extending outwardly from each said retainer member.

6. The structural support beam of claim 4 further including a reinforcing rib extending downwardly from opposite side portions of said lower stabilizer.

7. A structural support beam configured to resist bending due to gravitational forces and external loads comprising a top substantially flat flange held in fixed spaced relationship relative to a bottom substantially concave flange by an interconnecting web including a concave lower surface having substantially the same radius of curvature as said bottom substantially concave flange and a lower stabilizer comprising a pair of retainer members operatively coupled together by an intermediate longitudinally disposed brace by a corresponding pair of coupling devices, each said retainer member including an inner surface disposed substantially perpendicular to said top substantially flat flange and said bottom substantially concave flange disposed to engage a corresponding end surface of said bottom substantially concave flange, a corresponding end surface of said substantially flat interconnecting web and a corresponding end surface of said top substantially flat flange to secure said top substantially flat flange, said bottom substantially concave flange and said interconnecting web together and limit longitudinal expansion thereof.

8. The structural support beam of claim 7 wherein said intermediate longitudinally disposed brace comprises a flexible element drawn tight or taut by said pair of coupling devices.

* * * * *